US006237882B1

(12) United States Patent
DiMuzio

(10) Patent No.: US 6,237,882 B1
(45) Date of Patent: May 29, 2001

(54) DECORATIVE DISPLAY

(75) Inventor: Louis Nichole DiMuzio, Prospect, CT (US)

(73) Assignee: Louis Nichole, Inc., Prospect, CT (US)

( * ) Notice: Subject to any disclaimer, the term of this patent is extended or adjusted under 35 U.S.C. 154(b) by 0 days.

(21) Appl. No.: 09/350,148

(22) Filed: Jul. 9, 1999

(51) Int. Cl.[7] ..... A45D 19/04
(52) U.S. Cl. ..... 248/175; 428/10
(58) Field of Search ..... 248/27.8, 175; 428/10; 47/41.01, 41.13; 211/60.1

(56) References Cited

U.S. PATENT DOCUMENTS

| | | | | |
|---|---|---|---|---|
| 3,647,605 | * | 3/1972 | Spiegel | 248/27.8 X |
| 5,127,184 | * | 7/1992 | Cosentino | 47/41.01 |
| 5,639,521 | * | 6/1997 | Fraus et al. | 428/10 X |
| 6,027,083 | * | 2/2000 | Chang | 47/41.01 X |

* cited by examiner

*Primary Examiner*—Ramon O. Ramirez
(74) *Attorney, Agent, or Firm*—Grimes & Battersby, LLP

(57) ABSTRACT

A decorative display is provided for the arrangement of foliage and flowers, either real or artificial, as well as a variety of decorative elements, such as fruit and vegetables, either real or artificial, or candles. The decorative display comprises a rigid support structure composed of a plurality of longitudinal and latitudinal arcuate members that define a plurality of openings to receive foliage and flowers, said support structure being substantially spherical in shape, although the bottom is flat so as to allow for the placement and display of the display on a flat surface such as a table. Mounted at regularly spaced intervals along said longitudinal and latitudinal arcuate members are a plurality of attaching means within which may be releasably secured protrusions or hollow cylinders adapted to hold and support pieces of fruit and vegetables as well as candle holders. The shape of the decorative display may also be toroidal so as to simulate a wreath or conical, so as to simulate a Christmas tree.

12 Claims, 17 Drawing Sheets

DECORATIVE DISPLAY

BACKGROUND OF THE INVENTION

1. Field of the Invention

The present invention relates generally to a decorative display, and, more particularly, to such a decorative display for arranging and displaying real or artificial flowers as well as real or artificial fruit and vegetables and other decorative elements, such as candles, ribbons, Christmas ball ornaments, pine cones, or any other item that may be attached by means of a pin, corkscrew, cuplet or skewer.

2. Description of the Prior Art

The prior art fails to specifically address either the problem or the solution arrived upon by applicant.

Artificial topiary forms have long been known and used for decorating and arranging flowers. Many of these topiary forms include projections for the attachment of the floral elements. For example, U.S. Pat. No. 3,630,811, which issued to Radus on Dec. 28, 1971 for Artificial Topiary Construction, discloses an artificial topiary construction having a base of penetrable material with a plurality of floral engaging elements and artificial floral elements selectively engageable thereupon. Furthermore, in U.S. Pat. No. 3,819,458, which issued to Kinderman et al. on Jun. 25, 1974 for Foldable Decorative Structure With Reinforcing Members, is disclosed a foldable decorative assembly with which real or simulated foliage may be mechanically joined. In addition, the design of such topiary forms may also be protected, as is evidenced by U.S. Design Pat. No. 126,210, which issued to A. Muhl on Apr. 1, 1941 for a Flower Holder consisting of a disc-shaped flower holder having a plurality of outwardly extending spikes.

Similarly, many topiary forms include a plurality of openings within which individual flower stems may be inserted so as to create a flower arrangement. For example, both U.S. Pat. No. 1,196,312, which issued to W. R. Struck on Aug. 29, 1916 for a Flower Holder, and U.S. Pat. No. 1,962,110, which issued to J. W. Ash on Aug. 25, 1931 for a Flower Holder, disclose flower holders having a pair of foraminous plates through which the stems of flowers may attached, the former by means of tie wires. Furthermore, U.S. Pat. No. 1,965,565, which issued to N. T. Bartlett on Apr. 3, 1933 for a Flower Holder discloses a flower holder having a pair of horizontal reticulated members for holding the stems of flowers therein. In addition, a flower holder having a hollow dome with a plurality of apertures with rigid trough shaped guides projecting therefrom is disclosed in U.S. Pat. No. 2,981,033, which issued to J. E. Cheetwood on Aug. 19, 1957 for a Flower Holder, with the dome covering a deformable porous material for supporting stems of flowers. Similarly, U.S. Pat. No. 3,768,202, which issued to J. E. Wheelock on Oct. 30, 1973 for a Flower Holder comprising a hollow, spheroidal body having a plurality of arched segments having stem-receiving openings. U.S. Pat. No. 3,711,048, which issued to Thalenfeld on Jan. 16, 1973 for a Display Holder for Artificial Flowers and the Like discloses a grid structure for the support of artificial flowers. U.S. Pat. No. 5,375,370, which issued to C. H. Zimmerman on Dec. 27, 1994 for Flower Arrangement Holder, discloses a plate having a plurality of annular arrays of openings to permit reception of individual flower stems. U.S. Pat. No. 5,506,009, which issued to Stolzman, et al. on Apr. 9, 1996 for a Decoration and Method of Making the Same discloses a decorative display unit comprising a base with a plurality of openings through which flexible decorating strips may be interwoven. Even design patents have been granted for such topiary forms, as evidenced by U.S. Design Pat. No. 92,115, which issued to E. Spencer on Feb. 12, 1934, which discloses the ornamental design for a Flower Holder with a plurality of openings for insertion of flower stems.

As will be appreciated, none of these prior patents even address the problem faced by applicant let alone offer the solution proposed herein.

SUMMARY OF THE INVENTION

Against the foregoing background, it is a primary object of the present invention to provide a shaped decorative display for the arrangement and display of real and artificial flowers.

It is another object of the present invention to provide such a decorative display that may be easily arranged without the need of any tools or equipment by individuals without any experience in flower arranging.

It is yet another object of the present invention to provide such a decorative display that allows the arrangement of fruit and vegetables as well as flowers and foliage.

It is still another object of the present invention to provide such a decorative display that may include candles in candle holders as well as flowers and foliage.

It is yet another object of the present invention to provide such a decorative display which may be shaped in the form of a wreath, heart, hemisphere, ball, topiary, centerpiece, tree, candlestick or door display.

It is but another object of the present invention to provide such a decorative display that may be flat in shape so as to allow for the display of numerous candles.

It is yet still another object of the present invention to provide such a decorative display that is conical in shape so as to simulate a Christmas tree.

To the accomplishments of the foregoing objects and advantages, the present invention, in brief summary, comprises a rigid support structure composed of a plurality of longitudinal and latitudinal arcuate members that define a plurality of openings to receive foliage and flowers, said support structure being substantially spherical in shape, although the bottom is flat so as to allow for the placement and display of the display on a flat surface such as a table or placed in a bowl or other container. Mounted at regularly spaced intervals along said longitudinal and latitudinal arcuate members are a plurality of attaching means within which may be releasably secured protrusions adapted to hold and support pieces of fruit and vegetables as well as candle holders or a plurality of cuplets to hold fresh or artificial flowers or any other items which can be inserted into cuplets. Said protrusions include corkscrew-shaped screws or pins. The shape of the decorative display may also be toroidal so as to simulate a wreath or conical, so as to simulate a Christmas tree.

BRIEF DESCRIPTION OF THE DRAWINGS

The foregoing and still other objects and advantages of the present invention will be more apparent from the detailed explanation of the preferred embodiments of the invention in connection with the accompanying drawings, wherein.

DETAILED DESCRIPTION OF THE INVENTION

Figure 1A:
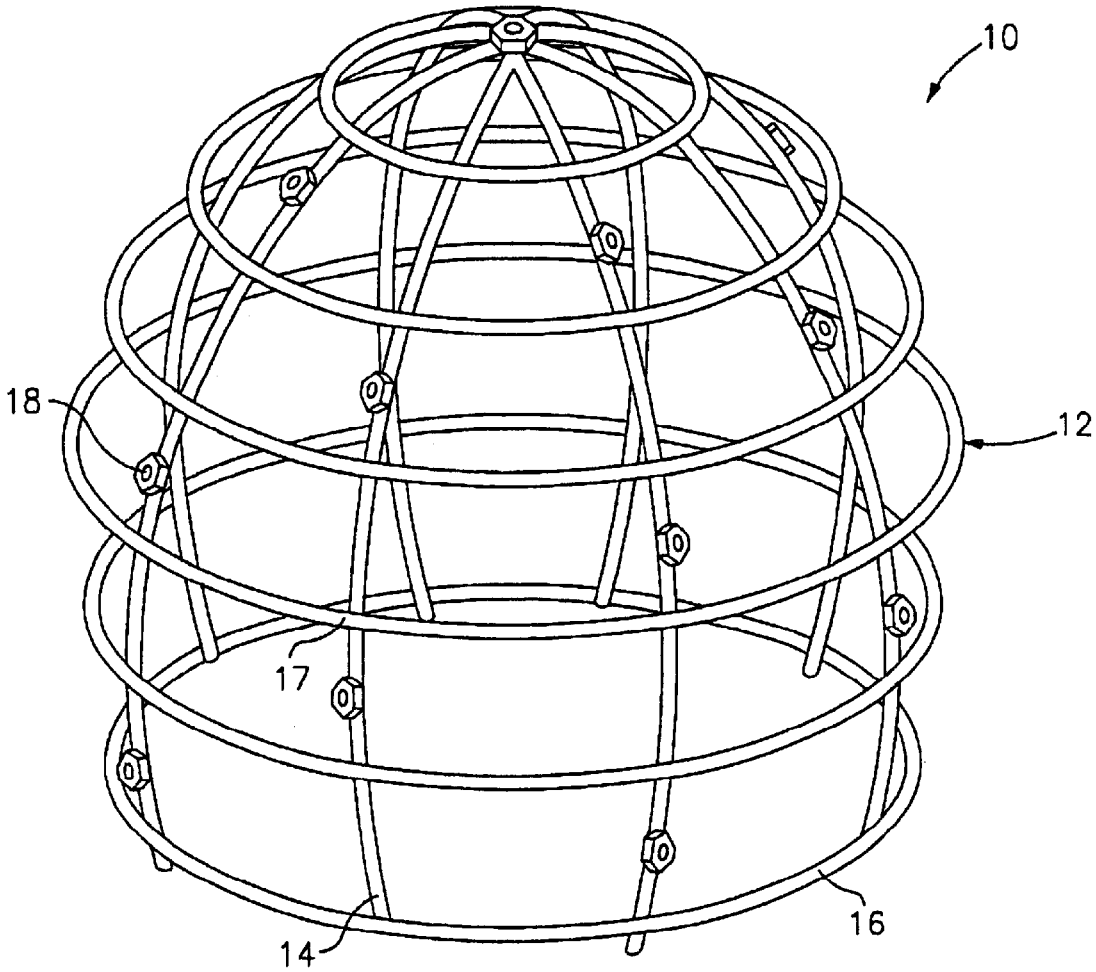
FIG. 1A is a front perspective view of the decorative display of the present invention without protrusions.
Figure 1B:
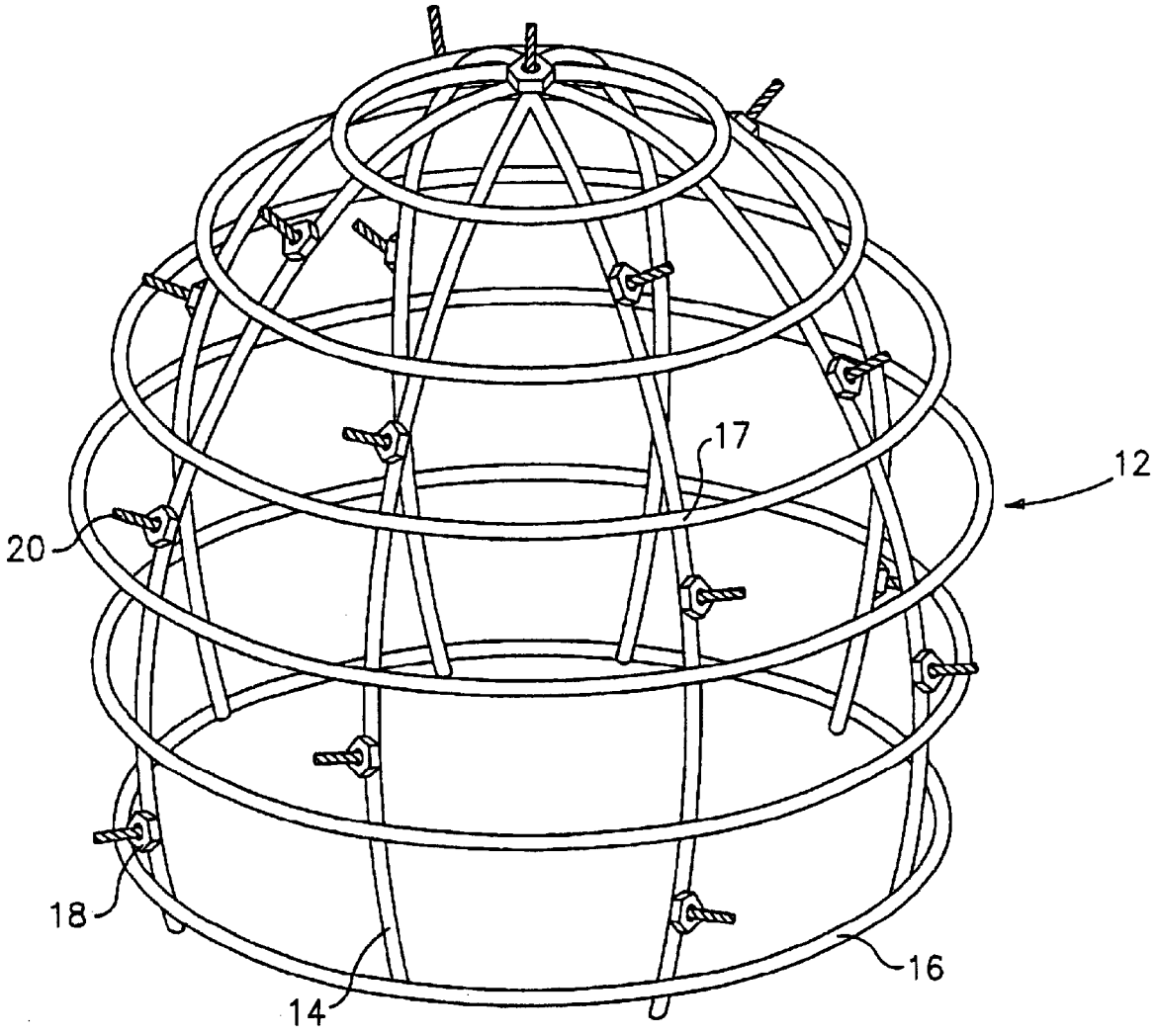
FIG. 1B is a front perspective view of the decorative display of the present invention with protrusions.
Figure 2:
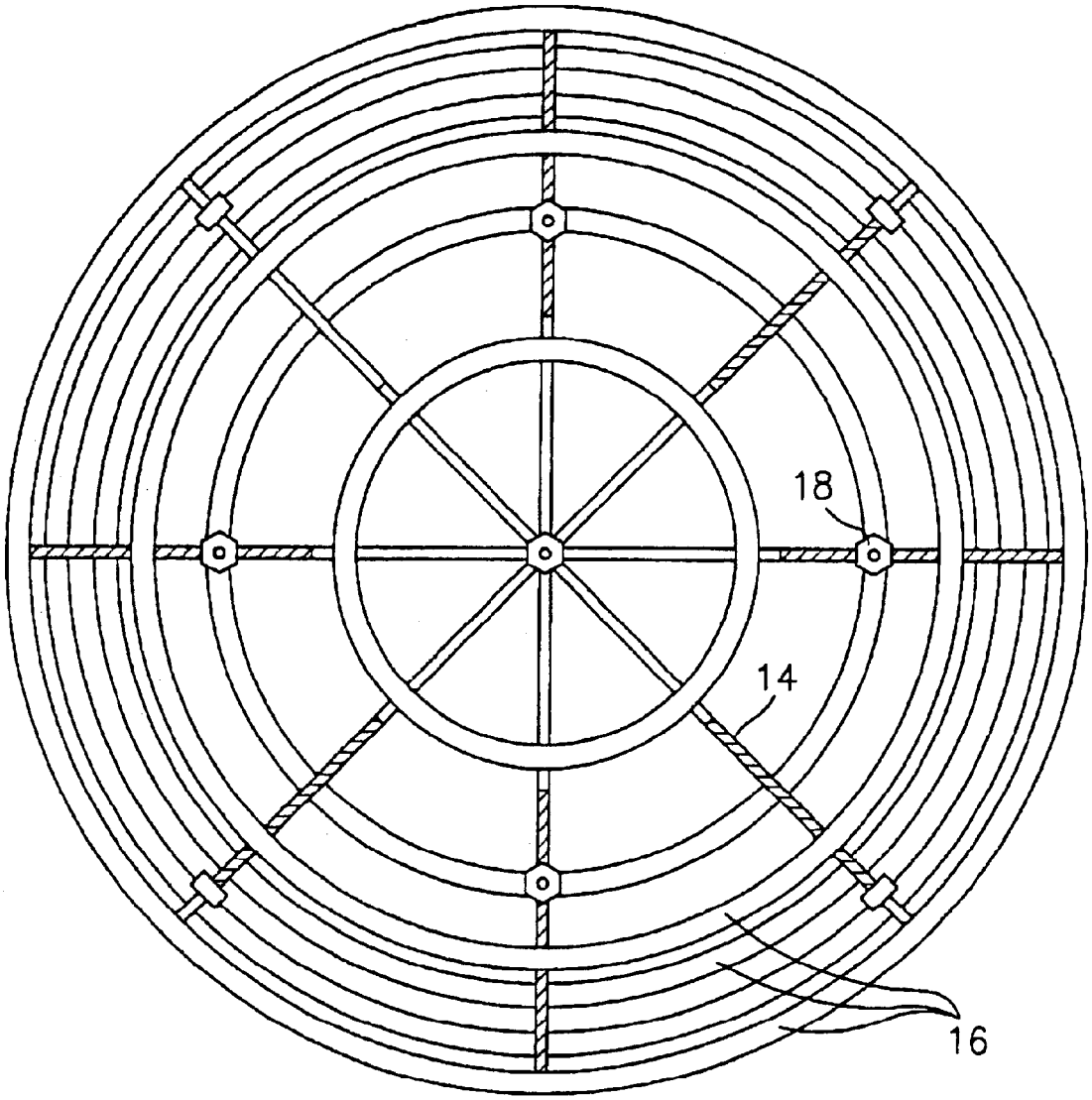
FIG. 2 is top view of the decorative display of FIG. 1.
Figure 3:
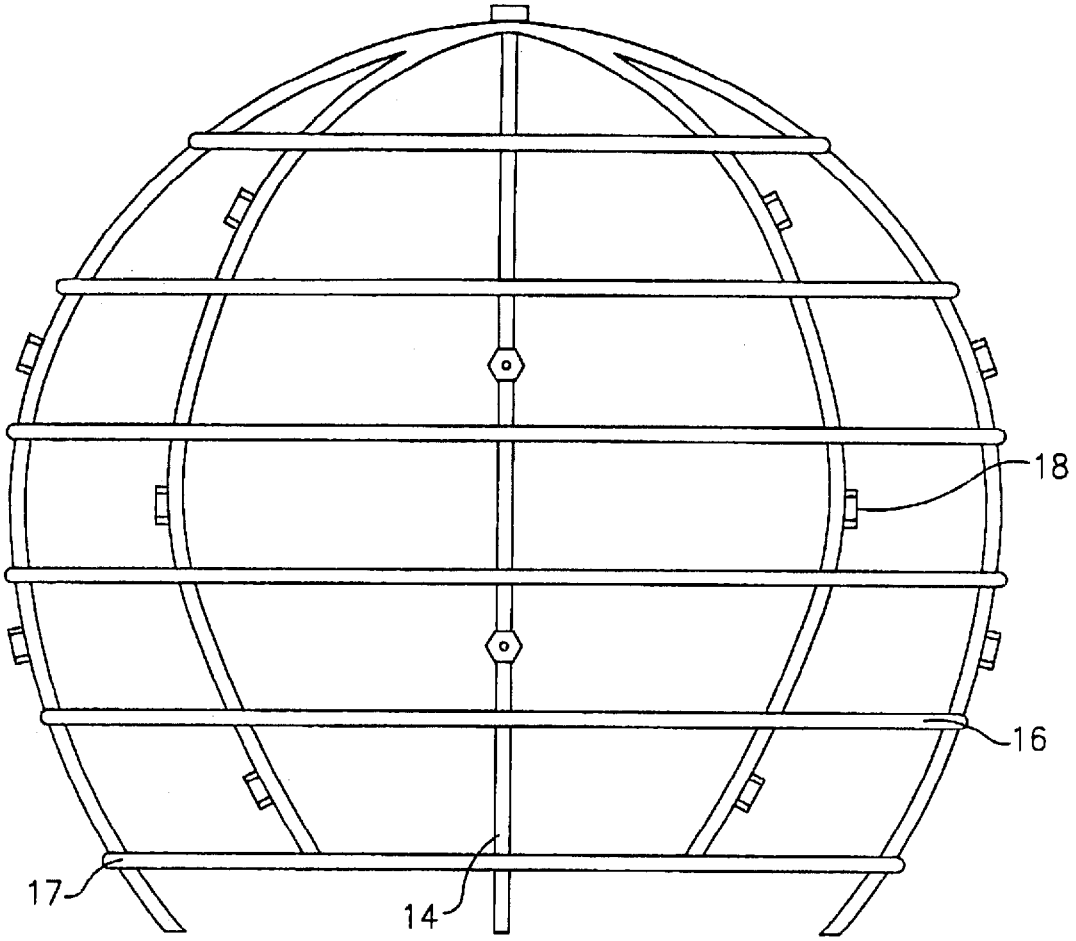
FIG. 3 is a front/back/side view of the decorative display of FIG. 1.
Figure 4:
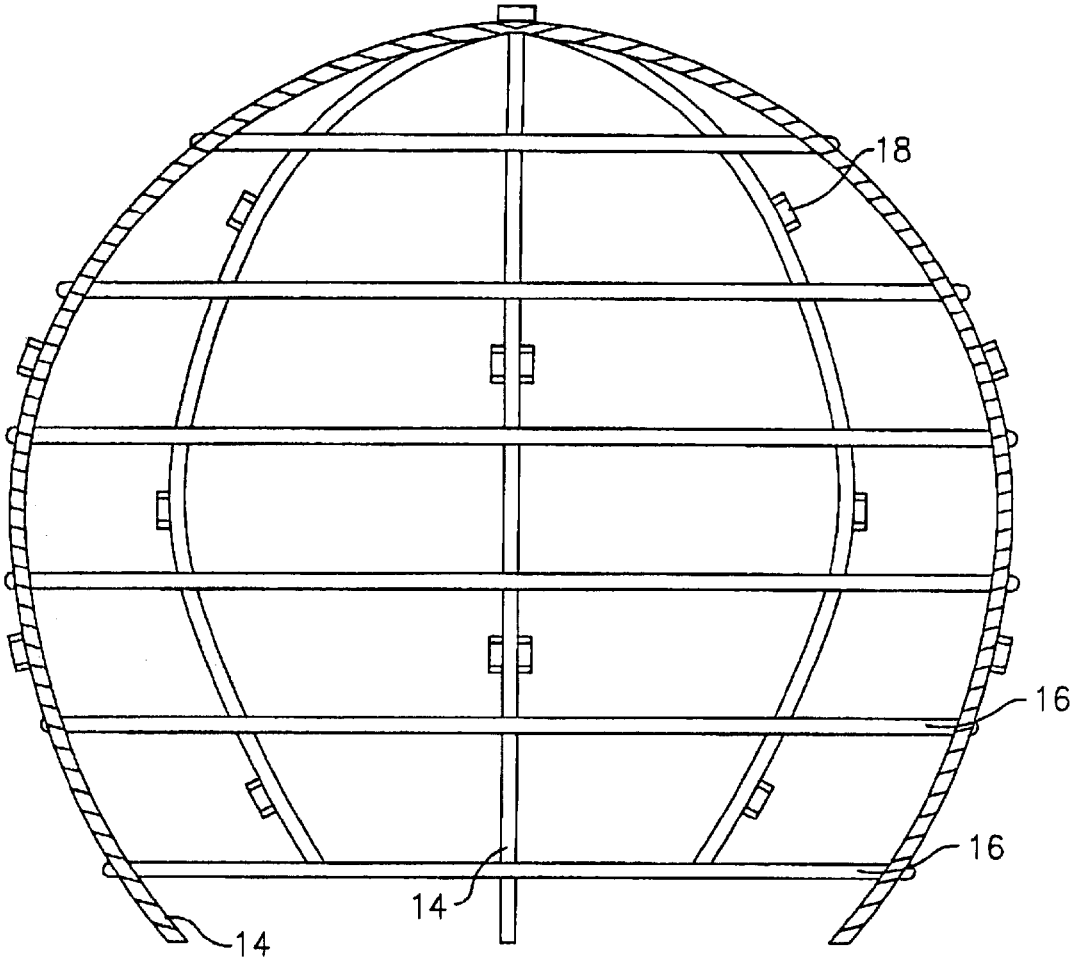
FIG. 4 is a cross-sectional view of the decorative display of FIG. 1.
Figure 5:
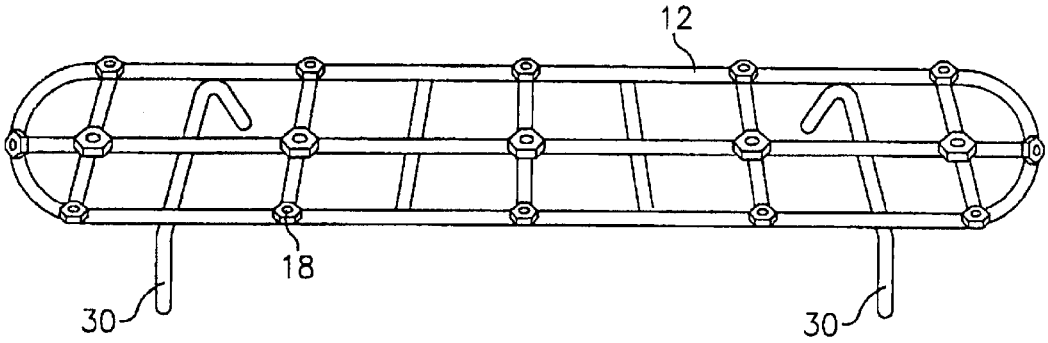
FIG 5 is a front perspective view of an alternate embodiment of the decorative display of the present invention.
Figure 6:
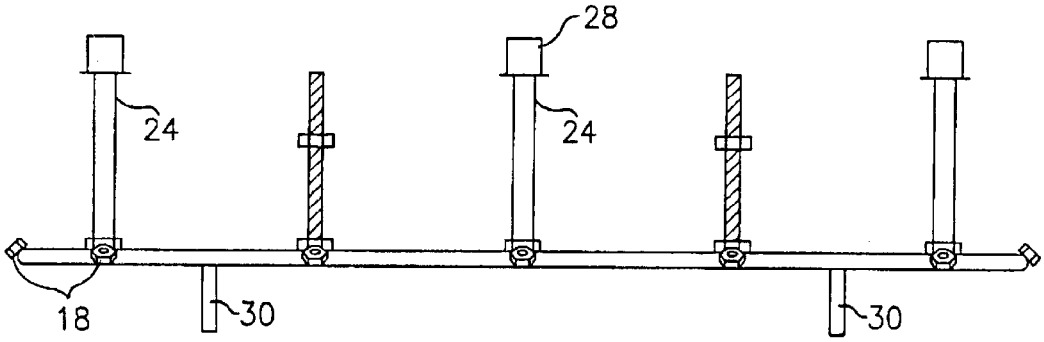
FIG. 6 is a front/back view of the alternate embodiment of the decorative display of FIG. 5.
Figure 7:
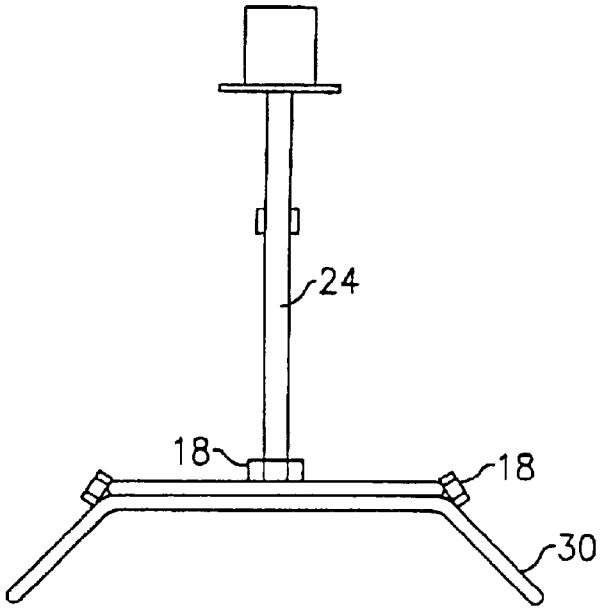
FIG. 7 is a side view of the alternate embodiment of the decorative display of FIG. 5.
Figure 8:
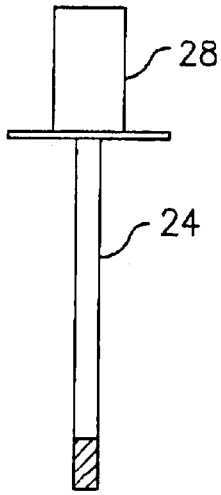
FIG. 8 is a front/back/side view of a candle holder.

Referring to the drawings and, in particular, to FIGS. 1A through 4 thereof, the decorative display of the present invention, referred to generally by reference numeral 10, is illustrated. The decorative display 10 essentially consists of a support structure 12 having a plurality of longitudinal arcuate members 14 and latitudinal arcuate members 16 joined at connection points 17. The longitudinal arcuate members 14 and latitudinal arcuate members 16 are spaced so as to allow the insertion and support of flower and plant stems.

The support structure 12 is composed of a rigid material so as to prevent deformation and to support the weight of the decorative elements placed therein and mounted thereon. In the preferred embodiment, the structure 12 is composed of steel wire. However, it should be appreciated that the structure 12 may also be composed of a slightly malleable material so as to allow the shape of the structure 12 to be altered while still providing the requisite support to hold all the decorative elements.

Mounted on the support structure 12 at regularly spaced intervals are a plurality of attachment means 18 adapted to releasably retain outwardly extending protrusions 20. In the preferred embodiment, the attachment means 18 are threaded nuts which are welded to the support structure 12, and the protrusions 20 are correspondingly threaded corkscrews adapted to screw into said nuts. The protrusions 20 may also be engaged to the attachment means 18 by a variety of alternate means, such as by a compression fit, or alternatively, by means of a locking mechanism (both not shown). In the preferred embodiment, the protrusions 20 consist of corkscrew shaped pins. However, it should be appreciated that the protrusions 20 may take a variety of shapes adapted to retain specific decorative elements. For example, the protrusion 20 may be hook-shaped.

The length and shape of the protrusions 20 are dictated by the decorative elements to be mounted thereon. For example, if fruit 22 or vegetable 23 is to be mounted to the decorative display 10, the protrusions 20 should be long enough and sturdy enough to hold the fruit 22 or vegetable 23 securely. Alternatively, if candles 24 are to be mounted on the decorative display 10, the protrusions 20 should be long enough so that the candle 24 clears any foliage or flowers 26 placed in the display 10. Further, if candles 24 are to be mounted on the display 10, the protrusions 20 would also include a cylindrical candle holder 28 at the end thereof.

Having thus described the invention with particular reference to the preferred forms thereof, it will be obvious that various changes and modifications can be made therein without departing from the spirit and scope of the present invention as defined by the appended claims. For example, in the second embodiment of the invention, illustrated in FIGS. 5 through 8, the shape of the structure 12 is substantially flat so as to allow the display of numerous candles 24 in addition to foliage or flowers 26 and fruit 22 and vegetables 23. The structure 12 in such embodiment includes support legs 30 so that the display 10 may be placed on a table. The attachment means 18 in such embodiment are mounted on an angle to the structure 12, so that any decorative elements attached thereto would be placed at such an angle.

Figure 9:
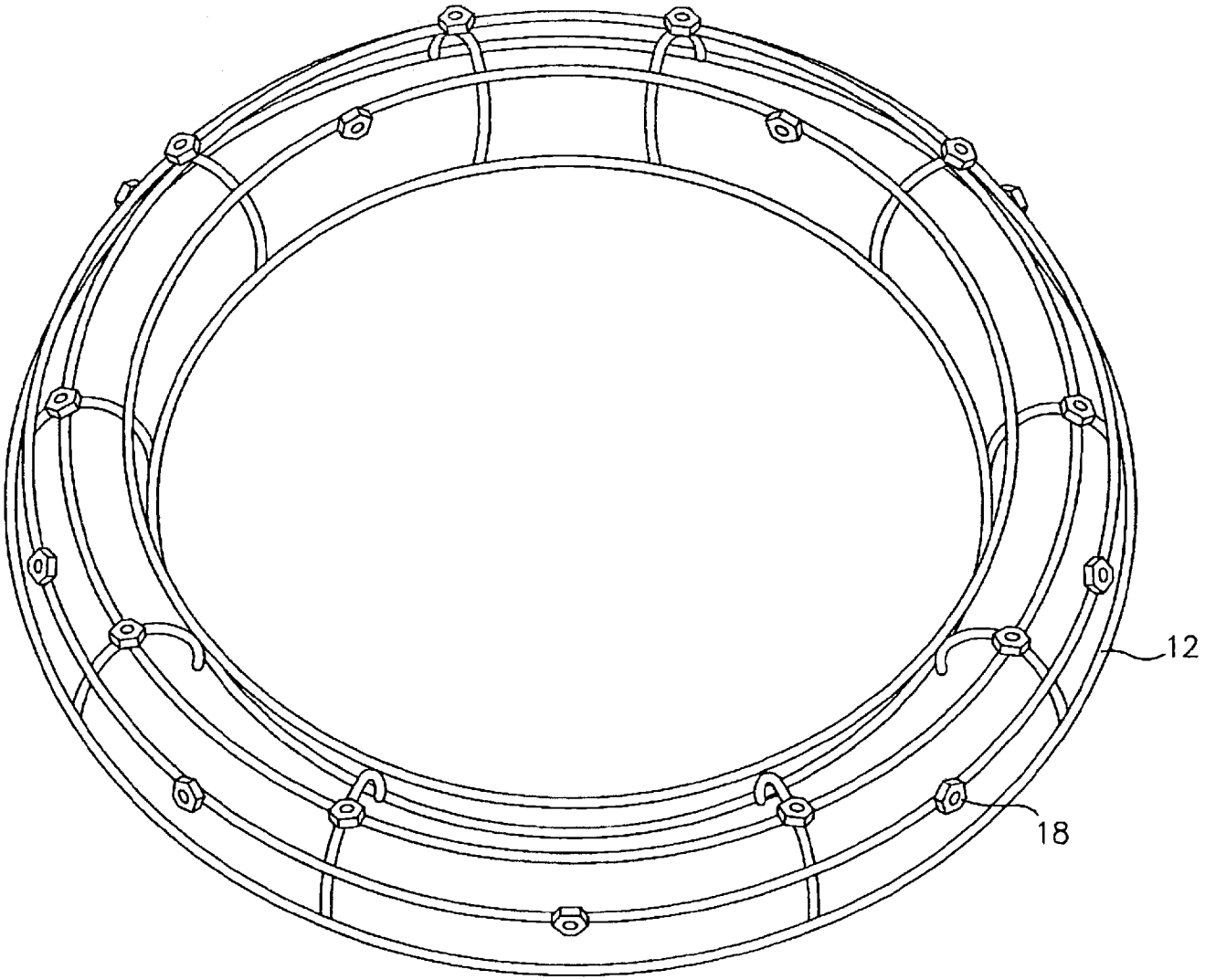
FIG. 9 is a front perspective view of another alternate embodiment of the decorative display of the present invention
Figure 10:
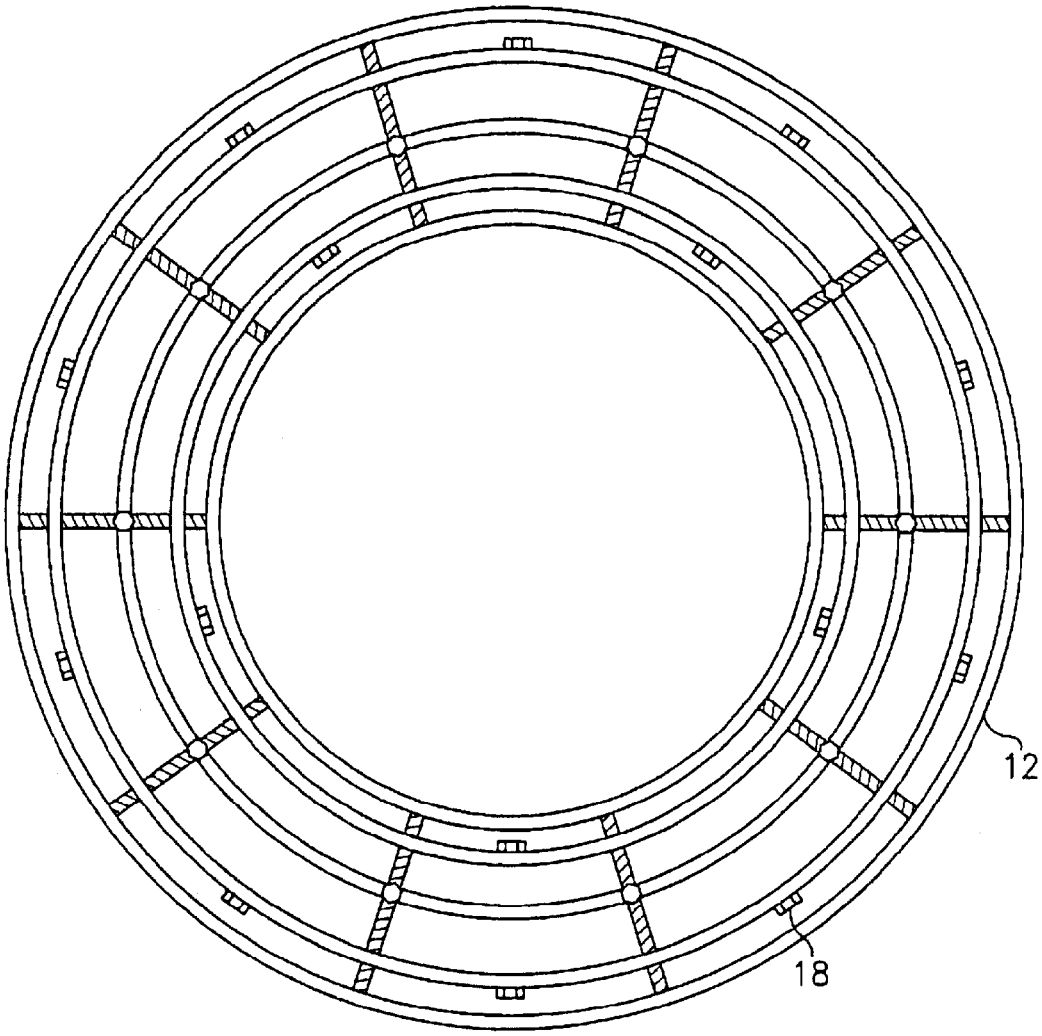
FIG. 10 is a top view of the alternate embodiment of the decorative display of FIG. 9.
Figure 11:
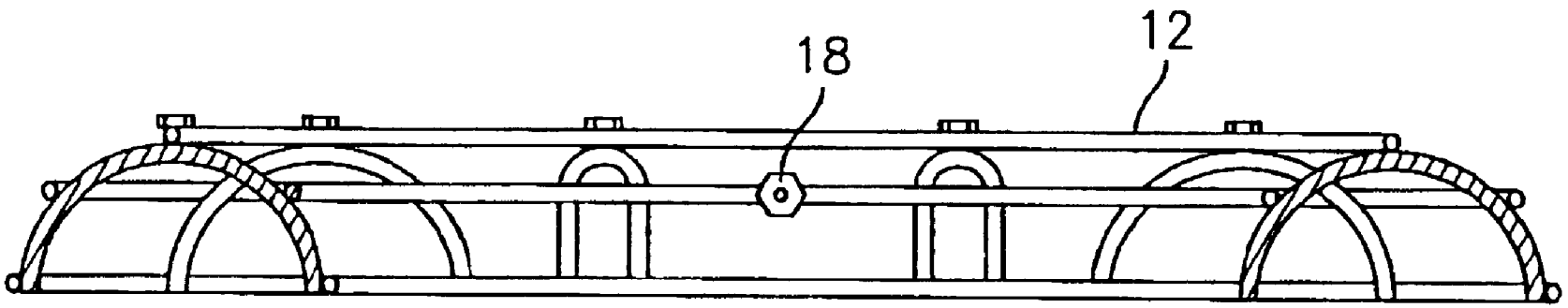
FIG. 11 is a cross-sectional view of the alternate embodiment of the decorative display of FIG. 9.
Figure 12:
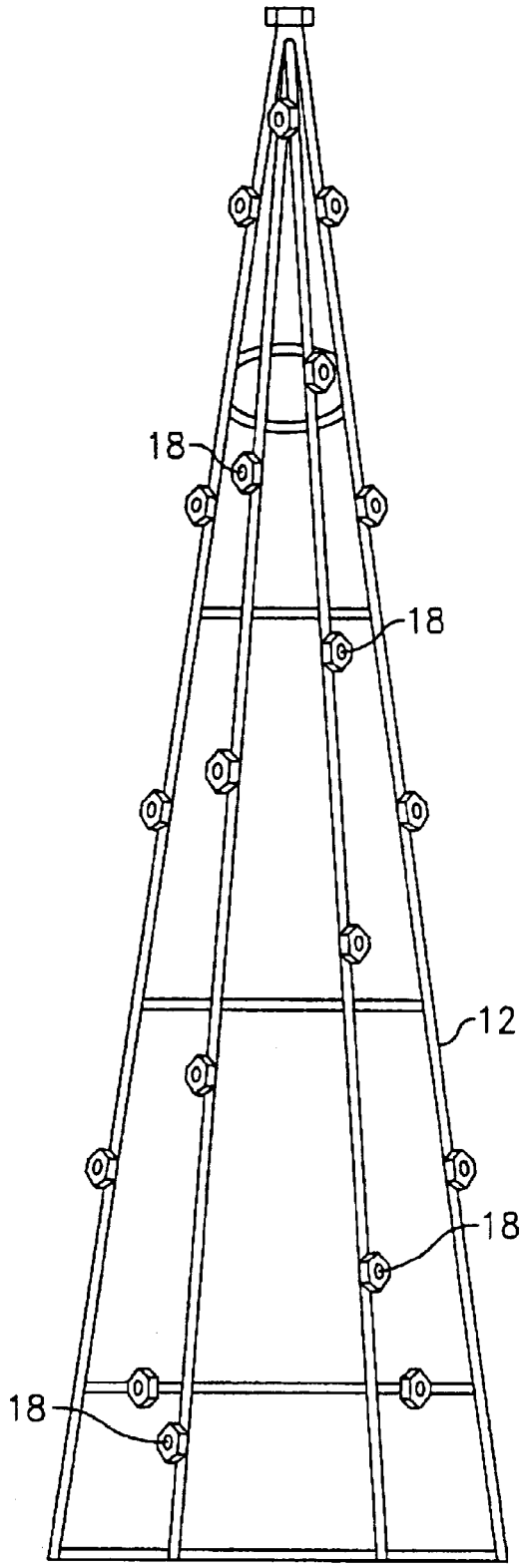
FIG. 12 is a front view of yet another alternate embodiment of the decorative display of the present invention.
Figure 13A:
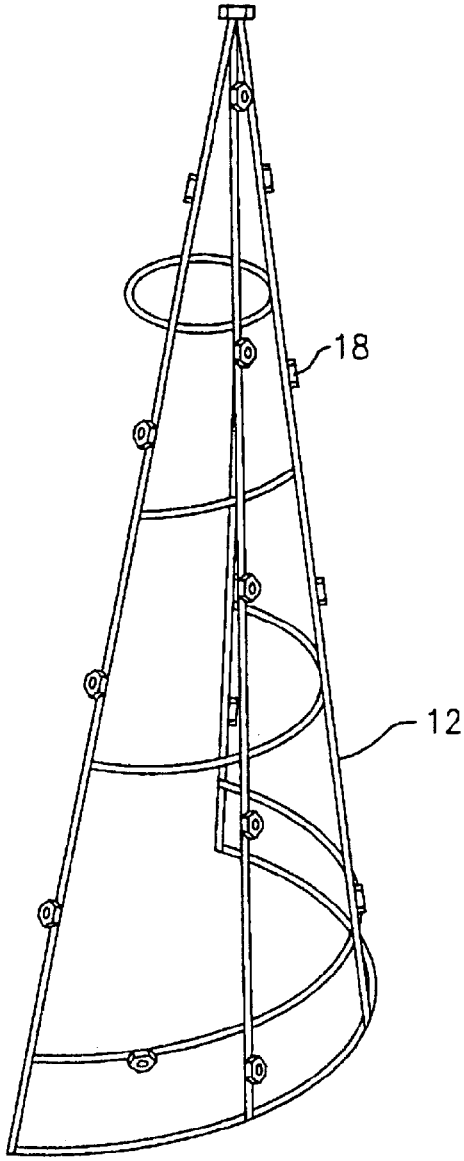
FIG. 13A is a cross-sectional view of the alternate embodiment of the decorative display of FIG. 12.
Figure 13B:
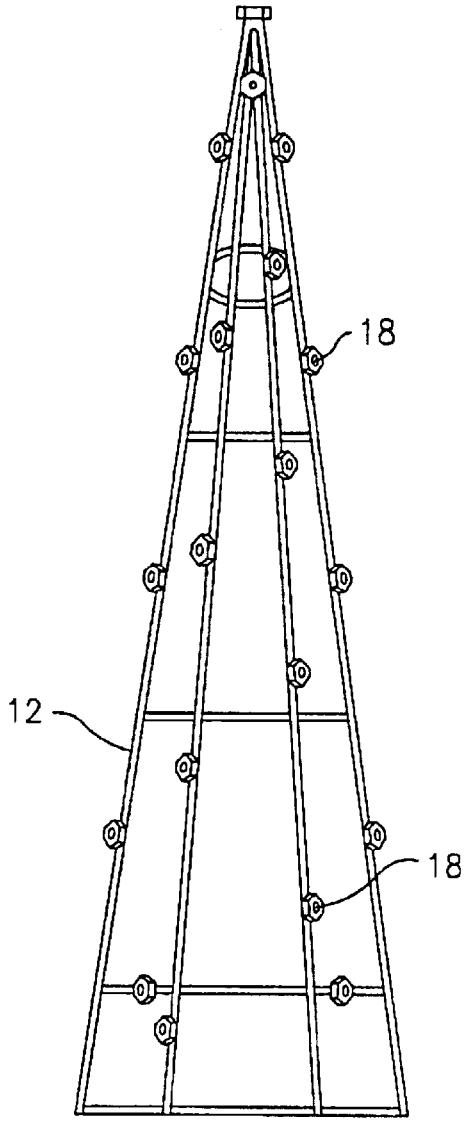
FIG. 13B is a front/back/side view of the alternate embodiment of the decorative display of FIG. 12.
Figure 14:
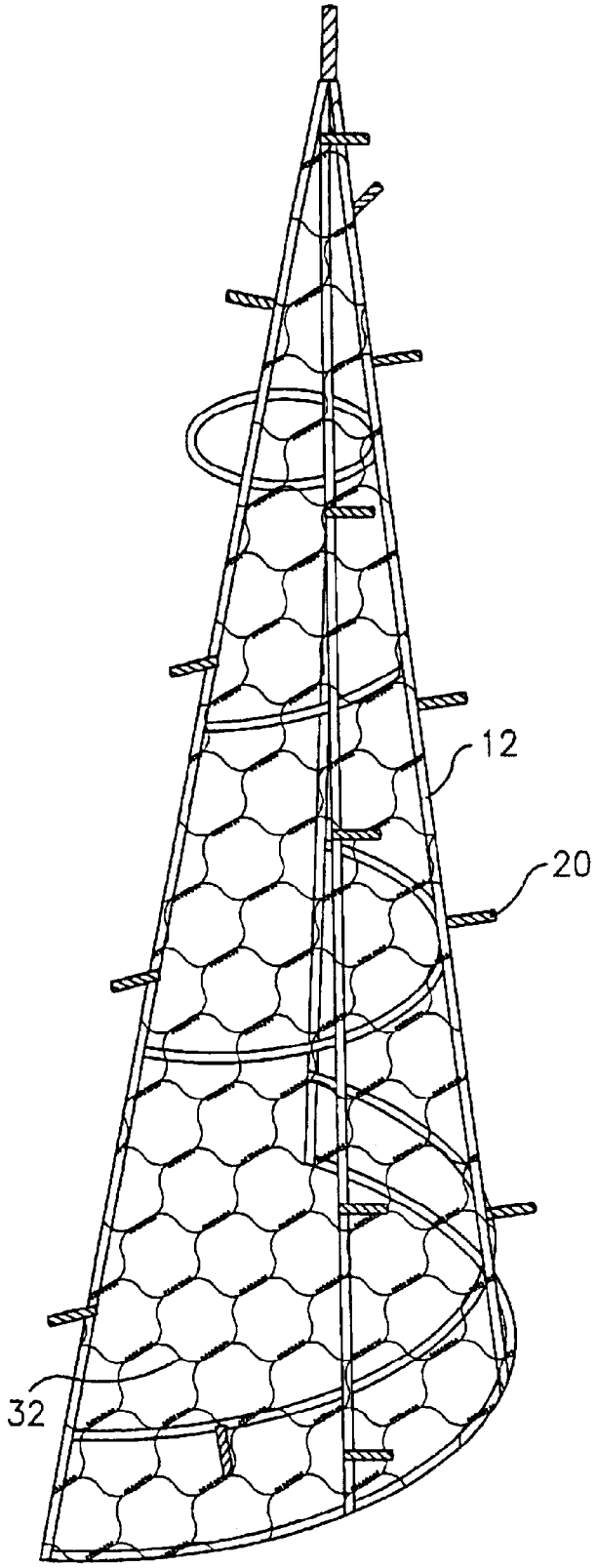
FIG. 14 is a cross-sectional perspective view of an alternate embodiment of the decorative display of FIG. 12.

In another embodiment of the invention, illustrated in FIGS. 9 through 11, the shape of the structure 12 is toroidal, so that, once decorated, the decorative display 10 looks like a wreath. In yet another embodiment of the invention, illustrated in FIGS. 12 through 14, the structure 12 is in the shape of a cone, such that, once decorated, the decorated display 10 looks like a Christmas tree. In this embodiment, as well as in all other embodiments, chicken wire 32 or some similar material may be wrapped around the structure 12 so as to provide additional support and shape, as well as to hold the foliage or flowers 26 more securely.

Figure 15A:
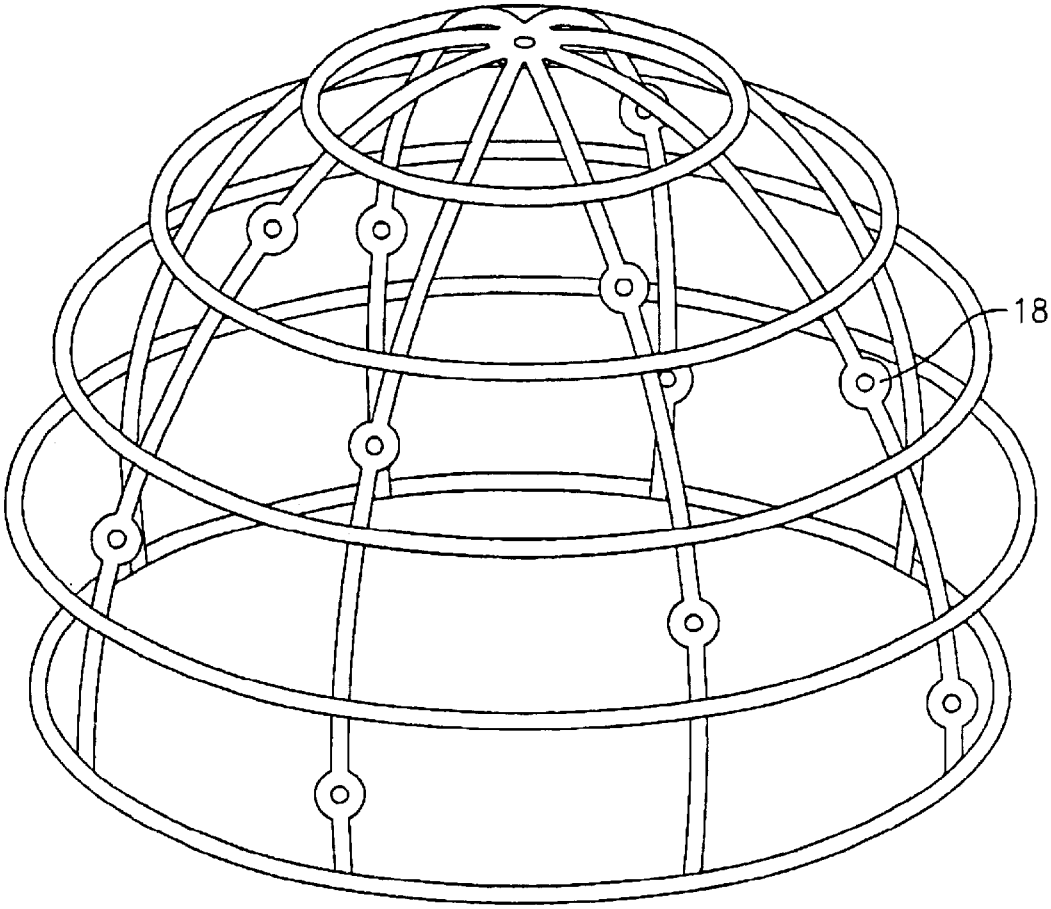
FIG. 15A is a front perspective view of an alternate embodiment of the decorative display of the present invention.
Figure 15B:
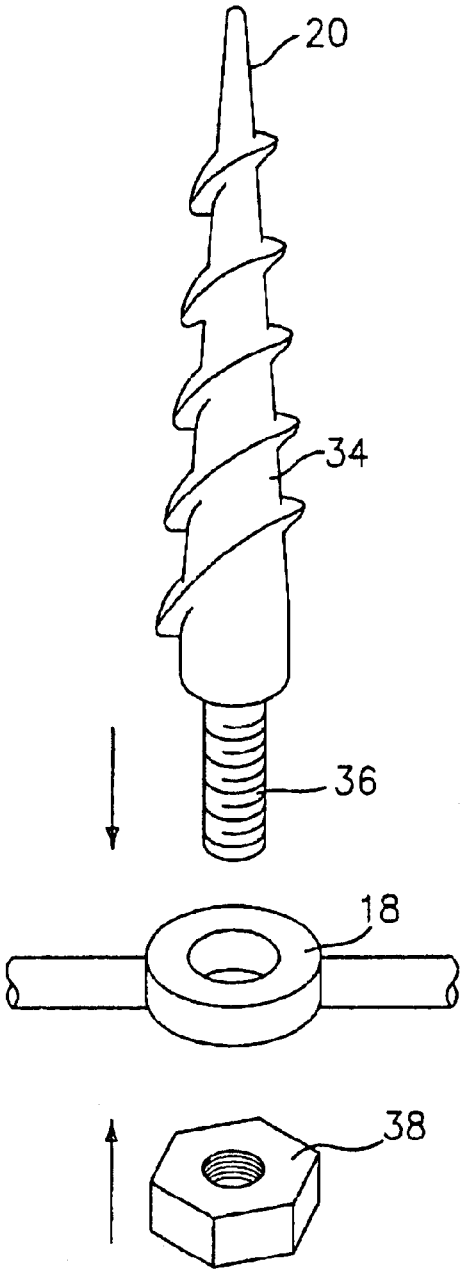
FIGS. 15B and 15C are perspective views of the attaching means of the alternate embodiment of FIG. 15A.
Figure 15C:
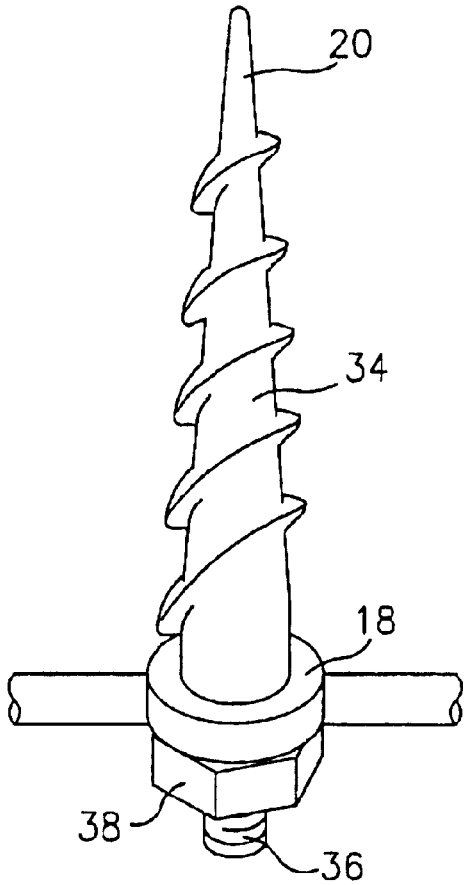

In FIGS. 15A–15C is shown an alternate protrusion 20

In another embodiment of the invention, illustrated in FIGS. 15A–C, an alternate means for attaching the protrusions 20 is shown. In such alternate means, the protrusion 20 is a corkscrew 34 having a threaded element 36 that may be inserted through attachment means 18 and secured by means of a threaded screw nut 38 By such means, the protrusions 20 may be easily and securely attached and released. In such embodiment, it should be appreciated that the attachment means 18 may be of any size or shape that will accommodate the threaded element 36, and need not be threaded nuts.

Figure 16:
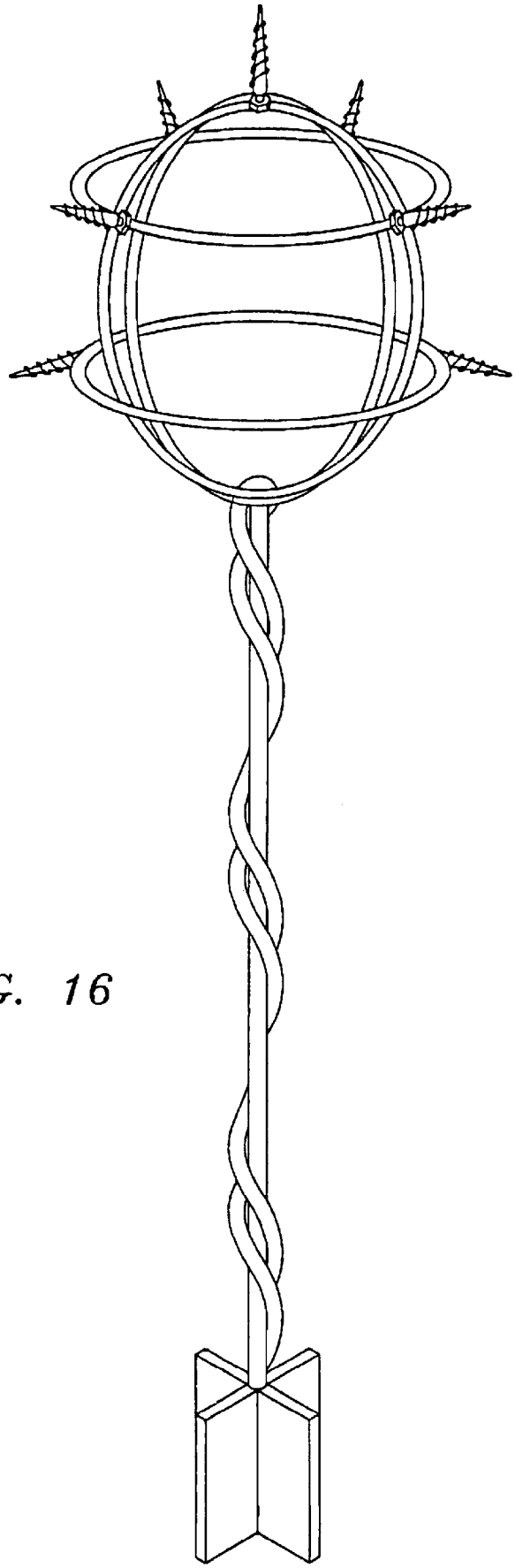
FIG. 16 is a front perspective view of yet another alternate embodiment of the decorative display of the present invention.

FIG. 16 illustrates an alternate embodiment of the decorative display 10 of the present invention in the shape of a tree.

Figures 17A, 17B:
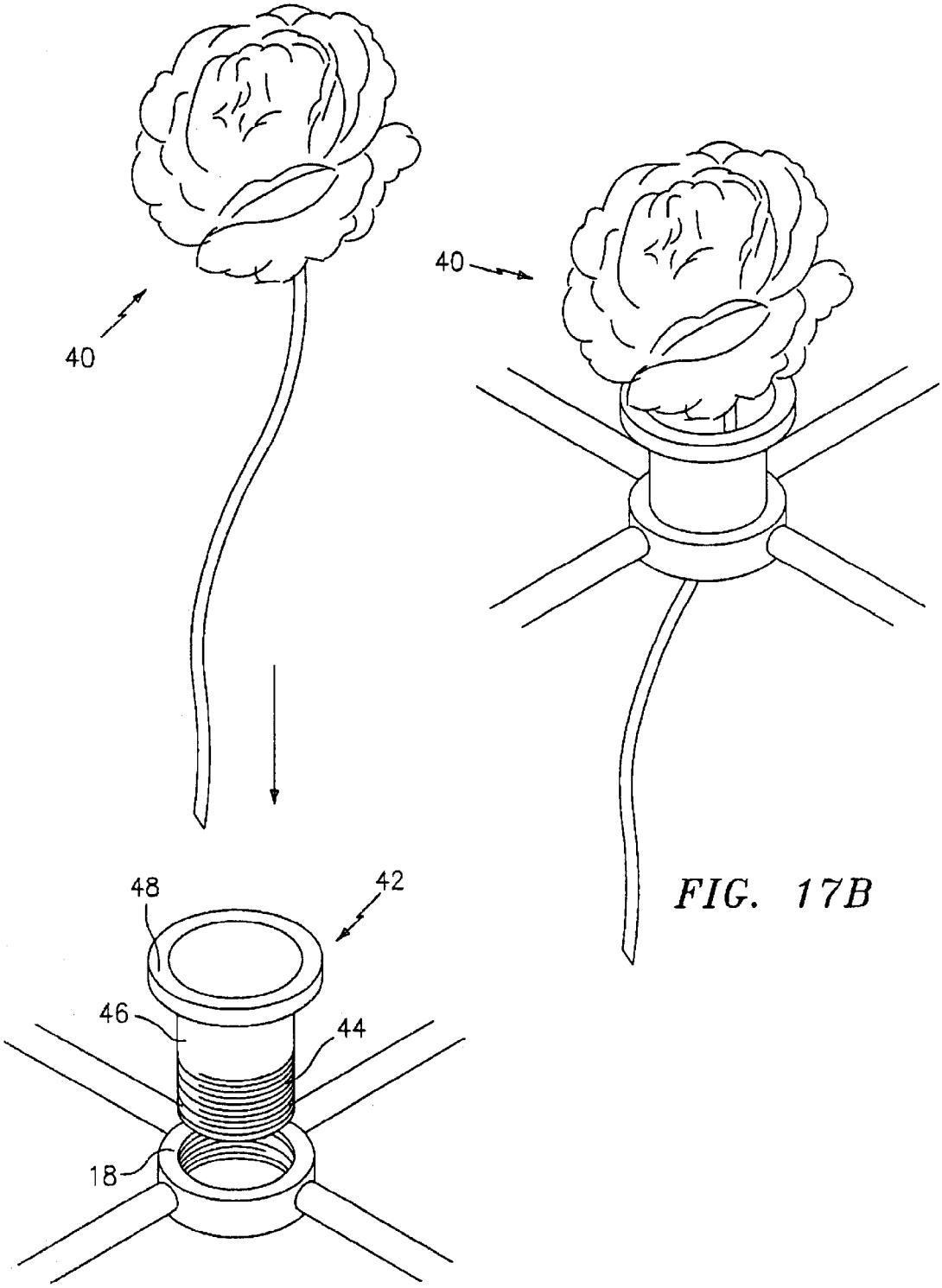
FIGS. 17A and 17B are front perspective views detailing the cuplet means for attachment.

FIGS. 17 and 18 illustrate an alternate means for attachment of decorative elements such as flowers 40. Such alternate means utilizes cuplets 42 attached to the decorative display 10. Such attachment may be by means of threads 44 which are complementary to threads in attachment means

18. Alternatively, the cuplets 42 may be affixed to the decorative display 10 by means of an adhesive or by welding.

The cuplets 42 consist essentially of a cylinder 46 having a lip 48 at the outer edge thereof. The diameter of the cylinder 46 is such that it would accommodate the stem of a flower 40 or artificial flower, or the base of a candle. The cuplet 42 may have a slight taper to its shape so as to more securely retain candles or other decorative elements that rely on friction to keep them secure.

Having thus described the invention with particular reference to the preferred forms thereof, it will be obvious that various changes and modifications can be made therein without departing from the spirit and scope of the present invention as defined by the appended claims.

What is claimed is:

1. A decorative display including:

a rigid support structure composed of a plurality of longitudinal and latitudinal arcuate members that define a plurality of openings to receive foliage and flowers; and a plurality of attaching means mounted at regularly spaced intervals along said longitudinal and latitudinal arcuate members adapted to releasably secure a plurality of protrusions, said protrusions being adapted to receive and retain at least one decorative element.

2. The decorative display of claim 1, wherein said decorative elements is selected from the group consisting of fruits, vegetables, candles and candies.

3. The decorative display of claim 1, further including a plurality of candle holders adapted to be releasably secured within said attaching means.

4. The decorative display of claim 1, said support structure being substantially spheroidal in shape.

5. The decorative display of claim 1, said support structure being substantially flat in shape, and further including support legs.

6. The decorative display of claim 1, said support structure being substantially toroidal in shape.

7. The decorative display of claim 1, said support structure being substantially conical in shape.

8. The decorative display of claim 1, further including a wire mesh to provide additional support for said foliage and flowers.

9. The decorative display of claim 1, wherein said attachment means consist of hollow cylindrical elements having a lip at the outer edge thereof.

10. A decorative display including:

a rigid support structure composed of a plurality of longitudinal and latitudinal arcuate members that define a plurality of openings to receive foliage and flowers, said support structure being substantially hemispherical in shape;

a plurality of attaching means mounted at regularly spaced intervals along said longitudinal and latitudinal arcuate members;

a plurality of protrusions adapted to be releasably secured within said attaching means, said protrusions adapted to hold and support pieces of fruit and vegetables; and a plurality of candle holders adapted to be releasably secured within said attaching means.

11. A decorative display including:

a rigid support structure composed of a plurality of longitudinal and latitudinal arcuate members that define a plurality of openings to receive foliage and flowers, said support structure being substantially hemispherical in shape;

a plurality of attaching means mounted at regularly spaced intervals along said longitudinal and latitudinal arcuate members, said attachment means consisting of hollow cylindrical elements having a lip at the outer edge thereof and being adapted to receive and retain at least one decorative element.

12. A method for creating a decorative display, said method comprising the steps of:

providing a rigid support structure composed of a plurality of longitudinal and latitudinal arcuate members that define a plurality of openings;

providing a plurality of attaching means mounted at regularly spaced intervals along said longitudinal and latitudinal arcuate members;

releasably securing a plurality of protrusions to said attaching means;

inserting foliage and flowers within said openings; and attaching a variety of fruit and vegetables to said protrusions.

* * * * *